US005467556A

United States Patent [19]

Lin

[11] Patent Number: 5,467,556

[45] Date of Patent: Nov. 21, 1995

[54] SHUTTER WINDOW ASSEMBLY

[76] Inventor: Tien-Wang Lin, No. 6, Lane 185, Chi Li Tan Rd., Jeou-Hsi Hsiang, Yi-Lan Hsien, Taiwan

[21] Appl. No.: 343,660

[22] Filed: Nov. 22, 1994

[51] Int. Cl.[6] ..... E06B 7/096

[52] U.S. Cl. ..... 49/82.1; 49/171

[58] Field of Search ..... 49/82.1, 74.1, 49/163, 166, 169, 171, 190, 191; 454/221, 224, 278

[56] References Cited

U.S. PATENT DOCUMENTS

| | | | |
|---|---|---|---|
| 2,272,722 | 2/1942 | Morin | 49/82.1 |
| 2,631,339 | 3/1953 | Pratt | 49/82.1 X |
| 2,651,085 | 9/1953 | Kopp | 49/82.1 X |
| 4,254,581 | 3/1981 | Ishihara | 49/82.1 |

*Primary Examiner*—Philip C. Kannan

*Attorney, Agent, or Firm*—Merchant, Gould, Smith, Edell, Welter & Schmidt

[57] ABSTRACT

A shutter window assembly including an aluminum window frame unit consisting of an outer window frame and a shutter, the shutter consisting of two stiles, a top rail, a bottom rail, and a plurality of horizontal louvers, two pairs of coupling blocks to connect the top and bottom rails to the stiles, two hinge devices connected between the shutter the outer window frame permitting the shutter to be retained within the outer window frame, and a shutter transmission mechanism installed in the aluminum window frame unit and controlled to open and close the shutter, the shutter transmission mechanism including a motor drive installed in the bottom rail of the shutter and having an output shaft disposed in one stile of the shutter, and a plurality of transmission devices disposed inside one stile and connected between the output shaft and the louvers, each transmission device including a gear box coupled to the motor drive, and a transmission rod coupled between the gear box and one louver and driven by the motor drive through the gear box to turn the respective louver.

1 Claim, 16 Drawing Sheets

SHUTTER WINDOW ASSEMBLY

BACKGROUND OF THE INVENTION

The present invention relates to a shutter window assembly including an aluminum outer window frame, a shutter mounted within the aluminum outer window frame by hinge devices, and a shutter transmission mechanism installed in the bottom rail and one stile of the shutter and controlled to turn the louvers of the shutter.

Various aluminum windows are well known and intensively used in variety of buildings. A regular aluminum window is generally comprised of an aluminum window frame, a screen window mounted within the aluminum window frame, a glass window mounted within the aluminum window frame and disposed in parallel with the screen window. The frames of the glass window and the screen window are commonly made by connecting aluminum profiles together. These aluminum profiles are generally connected together by iron plates and screws. After long uses, the connection between the aluminum profiles and the iron plates will be loosened. When the connection between the aluminum profiles and the iron plates is not secured, the glass sheet will disconnect from the aluminum frame. Furthermore, in order to regulate light through an aluminum window, a shutter may be installed. The installation of an external shutter needs much installation space. Furthermore, the shutter can only regulate light but cannot provide any other function such as a protection against an intrusion through the aluminum window.

SUMMARY OF THE INVENTION

It is one object of the present invention to provide a shutter window assembly which combines an aluminum window and a shutter into a unit.

It is another object of the present invention to provide a shutter window assembly in which the shutter can be closed tight to resist against the intrusion of thieves.

According to the preferred embodiment of the present invention, the shutter window assembly comprises an aluminum window frame unit consisting of an outer window frame and a shutter, the shutter consisting of two stiles, a top rail, a bottom rail, and a plurality of horizontal louvers, two pairs of coupling blocks to connect the top and bottom rails to the stiles, two hinge devices connected between the shutter the outer window frame permitting the shutter to be retained within the outer window frame, and a shutter transmission mechanism installed in the aluminum window frame unit and controlled to open and close the shutter, the shutter transmission mechanism including a motor drive installed in the bottom rail of the shutter and having an output shaft disposed in one stile of the shutter, and a plurality of transmission devices disposed inside one stile and connected between the output shaft and the louvers, each transmission device including a gear box coupled to the motor drive, and a transmission rod coupled between the gear box and one louver and driven by the motor drive through the gear box to turn the respective louver.

DETAILED DESCRIPTION OF THE PREFERRED EMBODIMENT

Referring to the annexed drawings in detail, a shutter window assembly in accordance with the present invention is generally comprised of a plurality of hinge devices 10, a shutter transmission mechanism 20, a plurality of coupling blocks 30, and an aluminum window frame unit 40.

Figure 1:
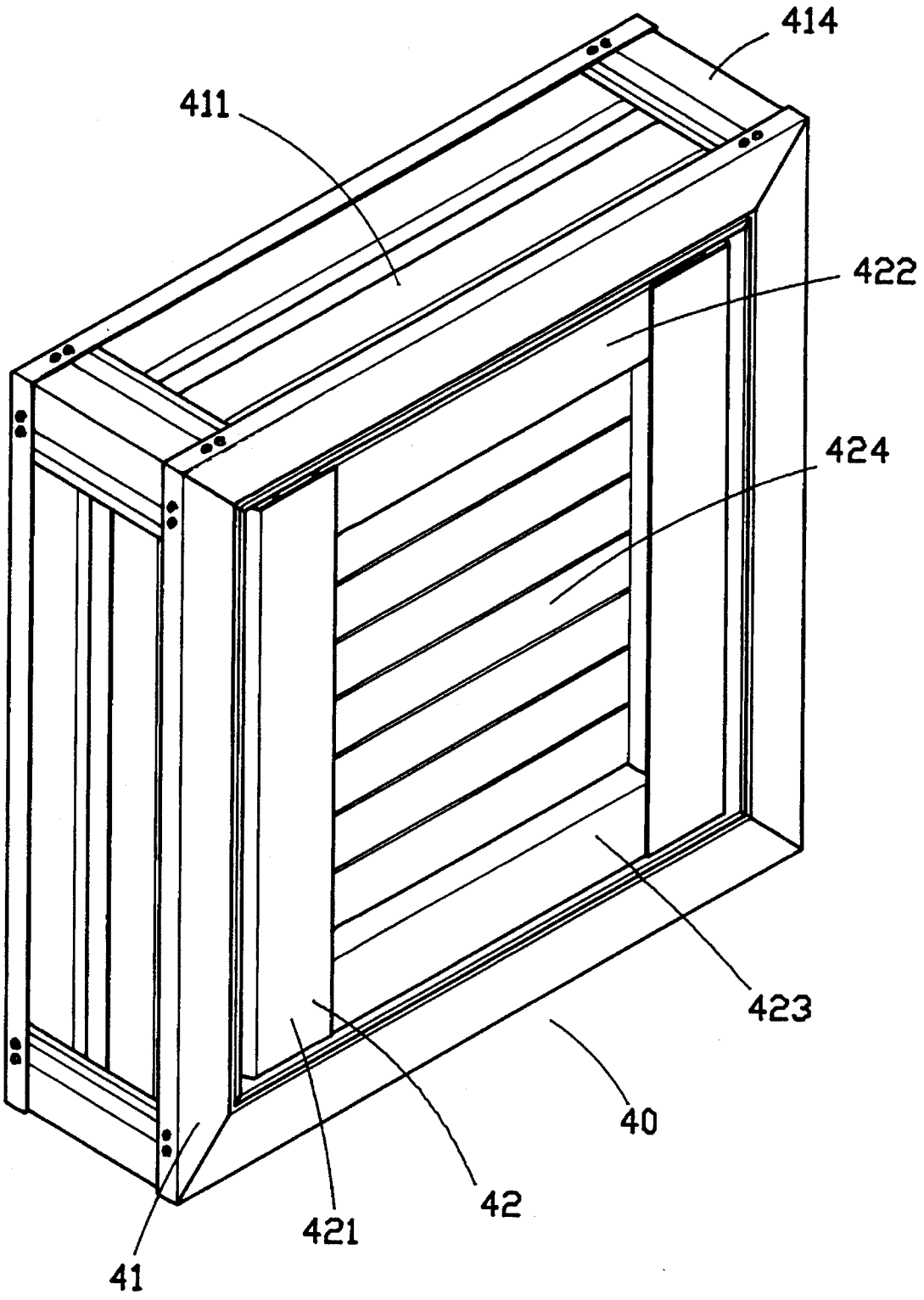
FIG. 1 is an elevational view of a shutter window assembly according to the preferred embodiment of the present invention.
Figure 2:
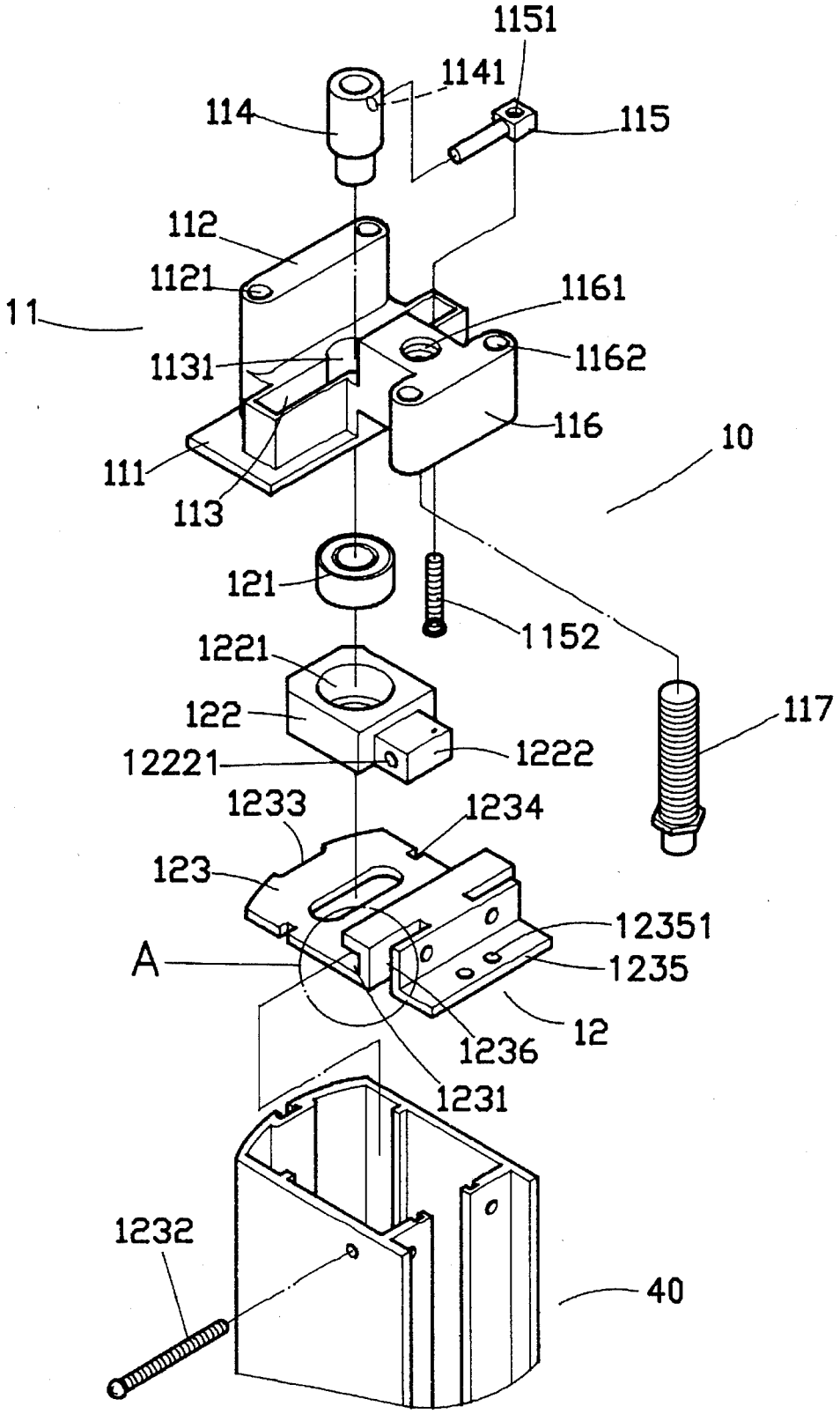
FIG. 2 is an exploded view of the upper locating block and pivot holder of a hinge device according to the present invention.
Figure 2A:
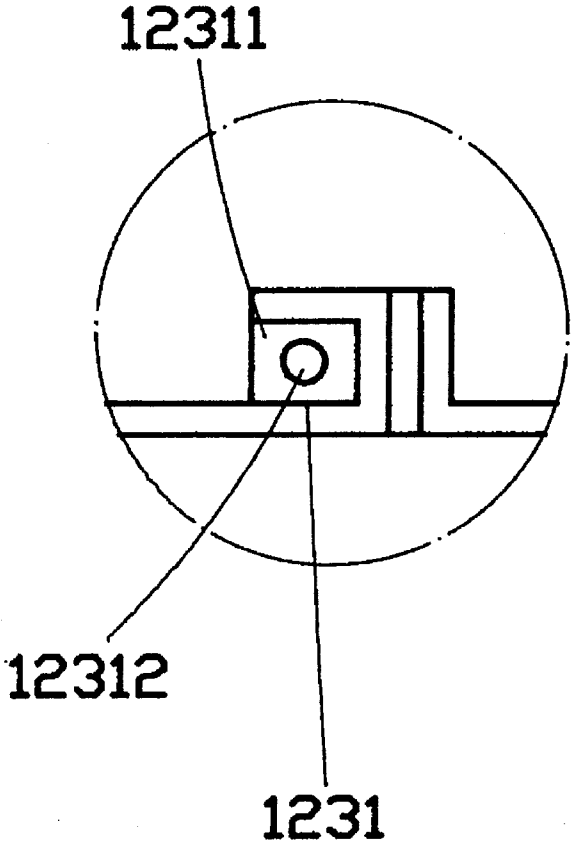
Figure 3:
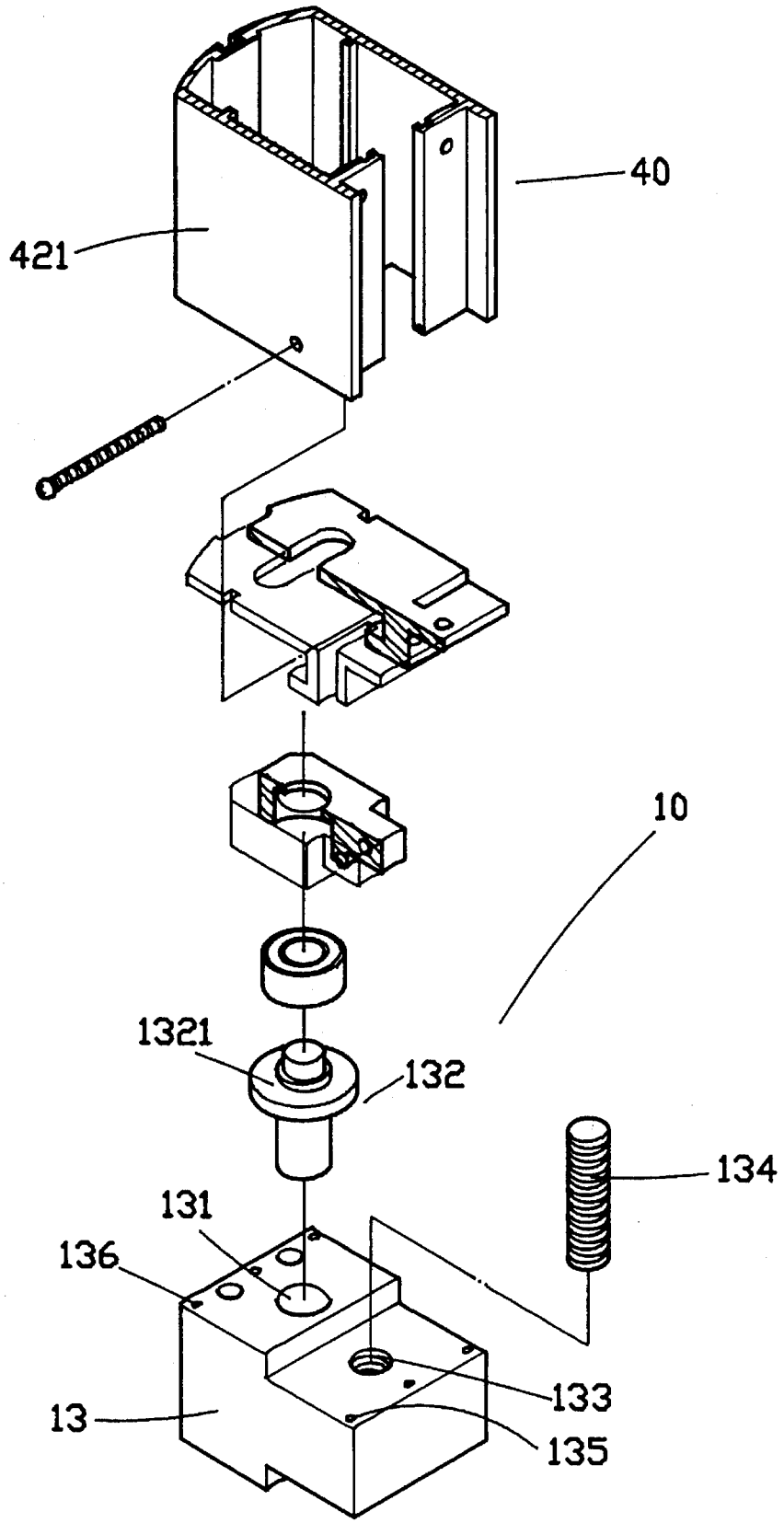
FIG. 3 is an exploded view of the lower locating block of a hinge device according to the present invention.
Figure 4:
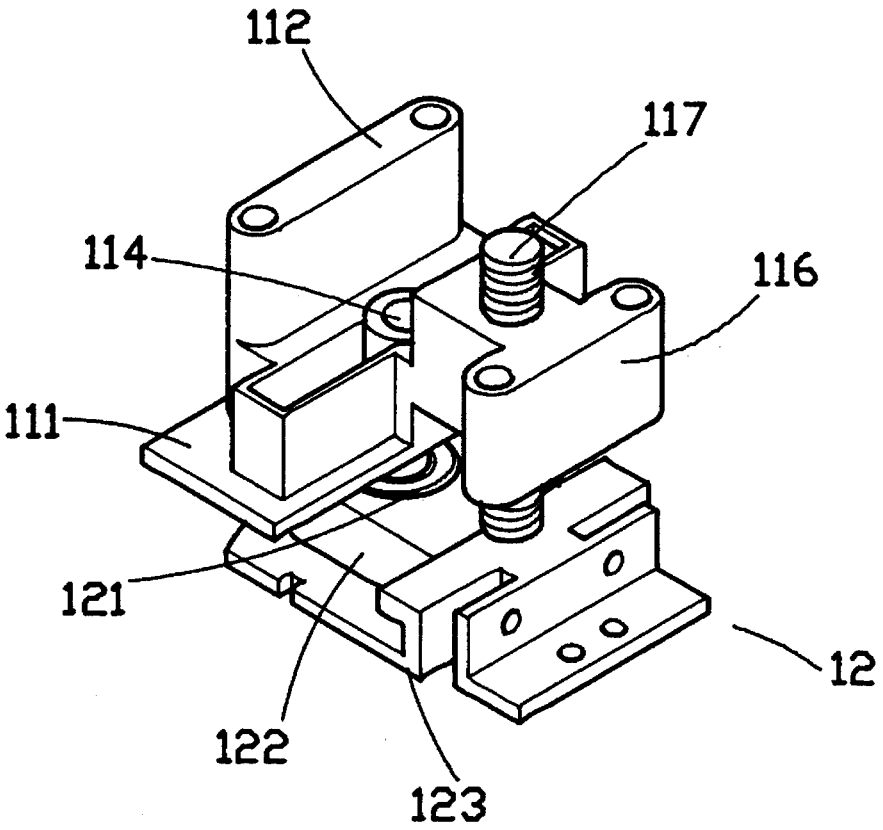
FIG. 4 is an assembly view of a hinge device according to the present invention.
Figure 4:
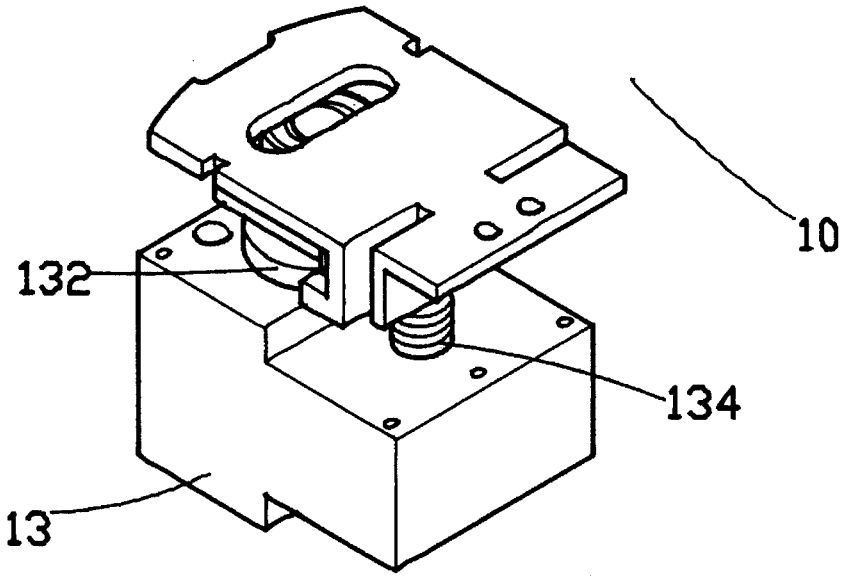

Referring to FIGS. 2, 3, and 4, the hinge device 10 is comprised of an upper locating block 11, two pivot holders 12, and a lower locating block 13. The upper locating block 11 comprises a flat base 111, an upright connecting block 112 raised from the flat base 111 at one side and having a pair of mounting holes 1121 at the top, an elongated chamber 113 disposed on the flat base 111 along the upright connecting block 112, a vertical center through hole 1131 through the center of the elongated chamber 113, a bolt 114 inserted into the vertical center through hole 1131 and having a side hole 1141, a rod 115 having one end fitted into the side hole 1141 on the bolt 114 and an opposite end made with a screw hole 1151, an adjusting screw 1152 threaded into the screw hole 1151 on the rod 115 from the bottom and turned to adjust the elevation of the bolt 114, a horizontal T-block 116 horizontally extended from the flat base 111 opposite to the upright connecting block 112 and having a center screw hole 1161 and two mounting holes 1162, and a balance adjustment screw 117 threaded into the center screw hole 1161. When the outer window frame 41 of the aluminum window frame unit 40 is mounted within the wall, the balance adjustment screw 117 can be adjusted to keep the outer window frame 41 horizontal. By means of the mounting holes 1162 of the T-block 116 and the mounting holes 1121 of the upper connecting block 112, the upper locating block 11 can be fastened to the outer window frame 41 of the aluminum window frame unit 40 on the inside. The pivot holder 12 comprises a bearing block 122 having a bearing hole 1221 and a projecting block 1222 with a screw hole 12221, an axle bearing 121 received in the bearing hole 1221 to support the bolt 114, and a locating block 123. The locating block 123 comprises a U-channel 1231, a stop block 12311 in the U-channel 1231, a screw hole 12312 on the stop block 12311 connected to the screw hole 12221 on the projecting block 1222 of the bearing block 122 by a screw 1232, which is fastened to the aluminum window frame unit 40, an angle frame 1235 having screw holes 12351, and two openings 1236 bilaterally disposed between the angle frame 1235 and the U-channel 1231. By turning the screw 1232 to move the bearing block 122 in the U-channel 1231 of the locating block 123, the position of the shutter 42 of the aluminum window frame unit 40 is adjusted horizontally. The locating block 123 further comprises two spaced notches 1233 and 1234 fitting the inside chamber 4211 of the stile 421 of the shutter 42. By means of the angle frame 1235 and the openings 1236, the pivot holder 12 can be fastened to inside flanges 4212 on the inside chamber 4211 of the stile 421 of the shutter 42 and the inside chamber of the top rail 422 of the shutter 42. The lower locating block 13 comprises a vertical locating hole 131, a bolt 132 inserted into the vertical locating hole 131 from the top and having an outward horizontal flange 1321 around the periphery stopped above the vertical locating hole 131, a vertical screw hole 133 disposed in parallel with the locating hole 131, a balance adjustment screw 134 threaded into the vertical screw hole 133 and adjusted to regulate the balance of the outer window frame 41 of the aluminum window frame unit 40 when the outer window frame 41 is mounted within the wall, and a plurality of screw holes 135 and 136 spaced along two opposite sides for fastening to the inside chamber of the outer window frame 41 of the aluminum window frame unit 40. The installation of the hinge device 10 permits the louvers of the shutter to be moved within the outer window frame 41 of the aluminum window frame unit 40.

Figure 5:
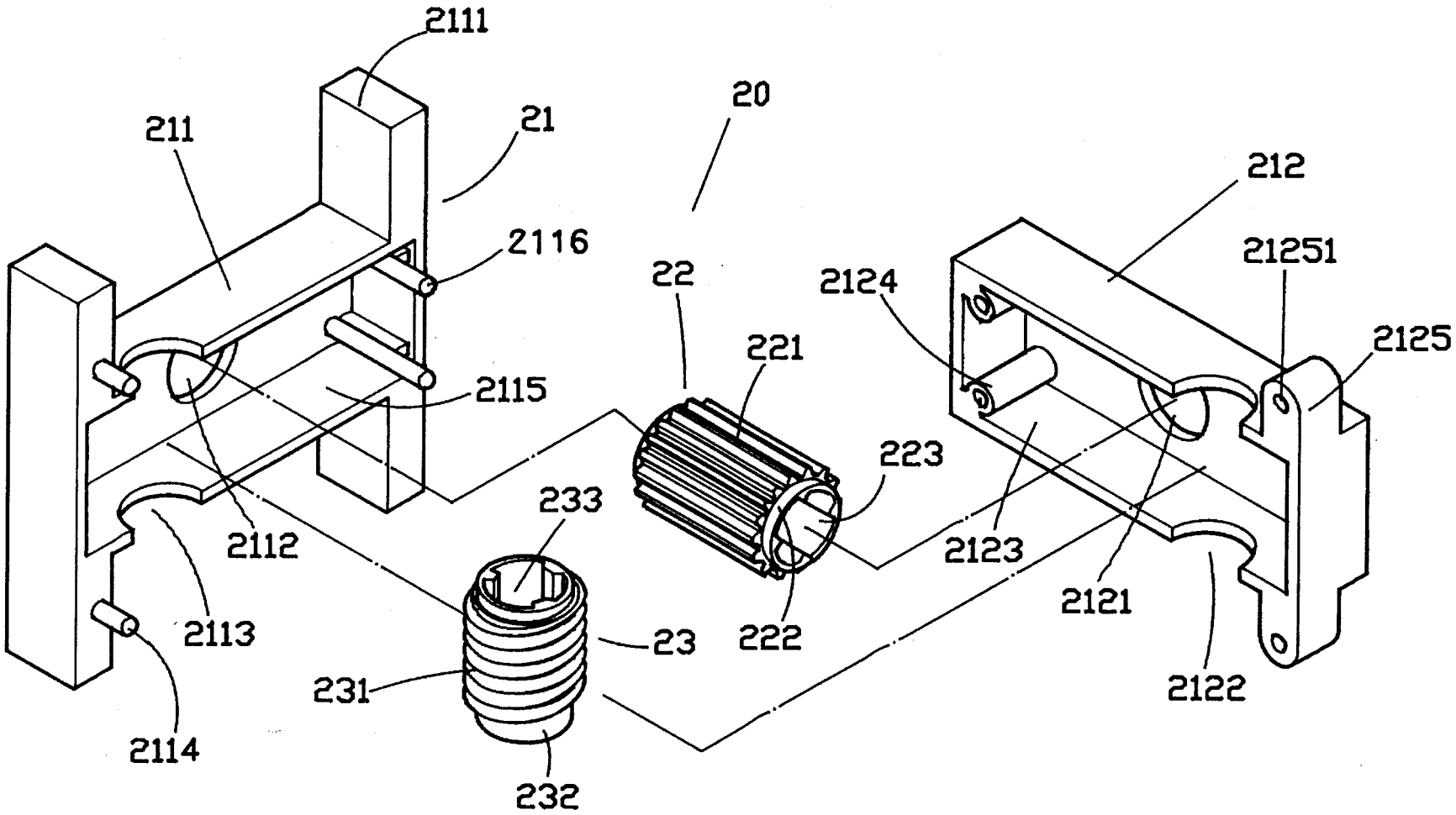
FIG. 5 is an exploded view of a transmission device according to the present invention.
Figure 6:
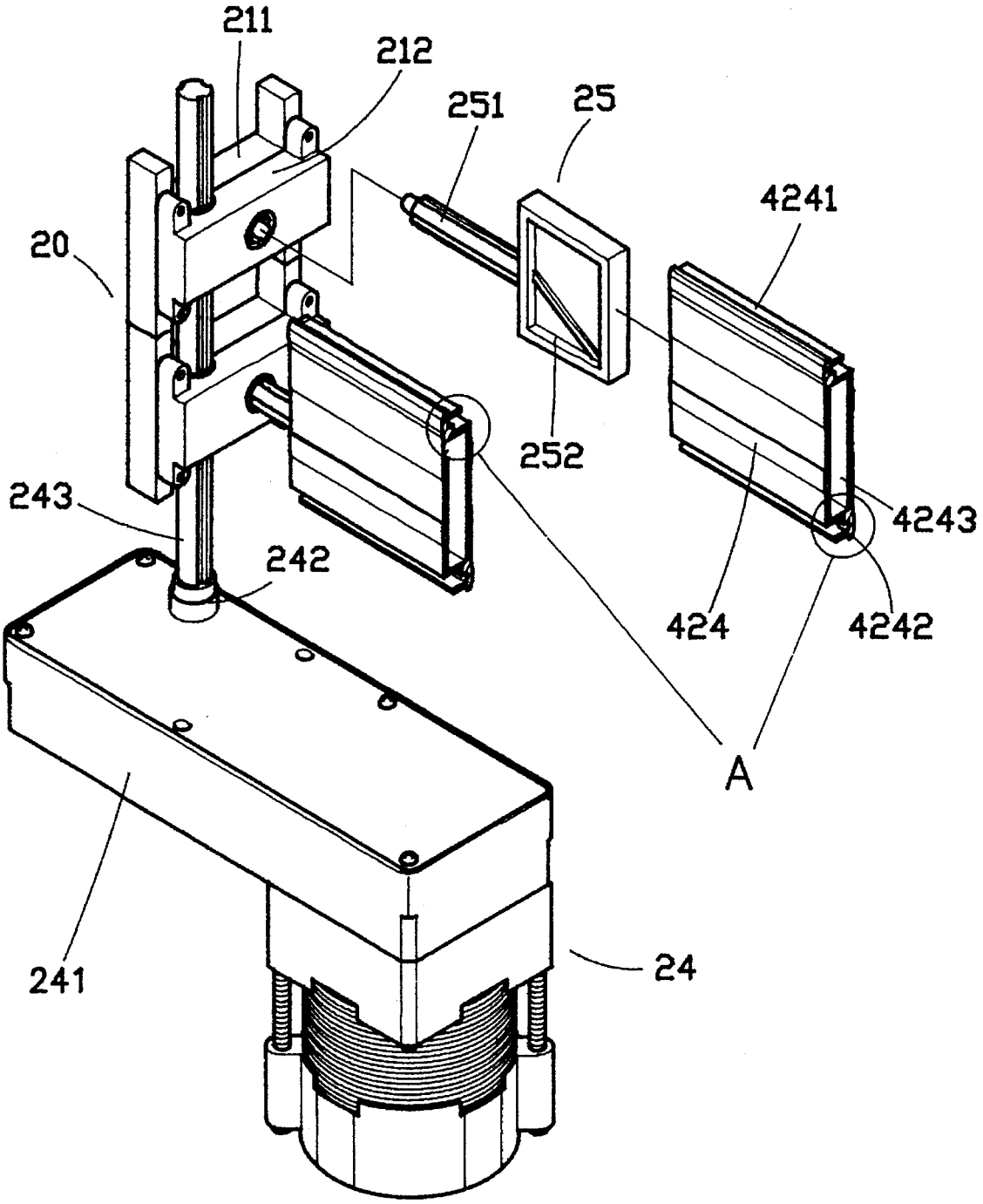
FIG. 6 shows a shutter transmission mechanism according to the present invention.
Figure 6A:
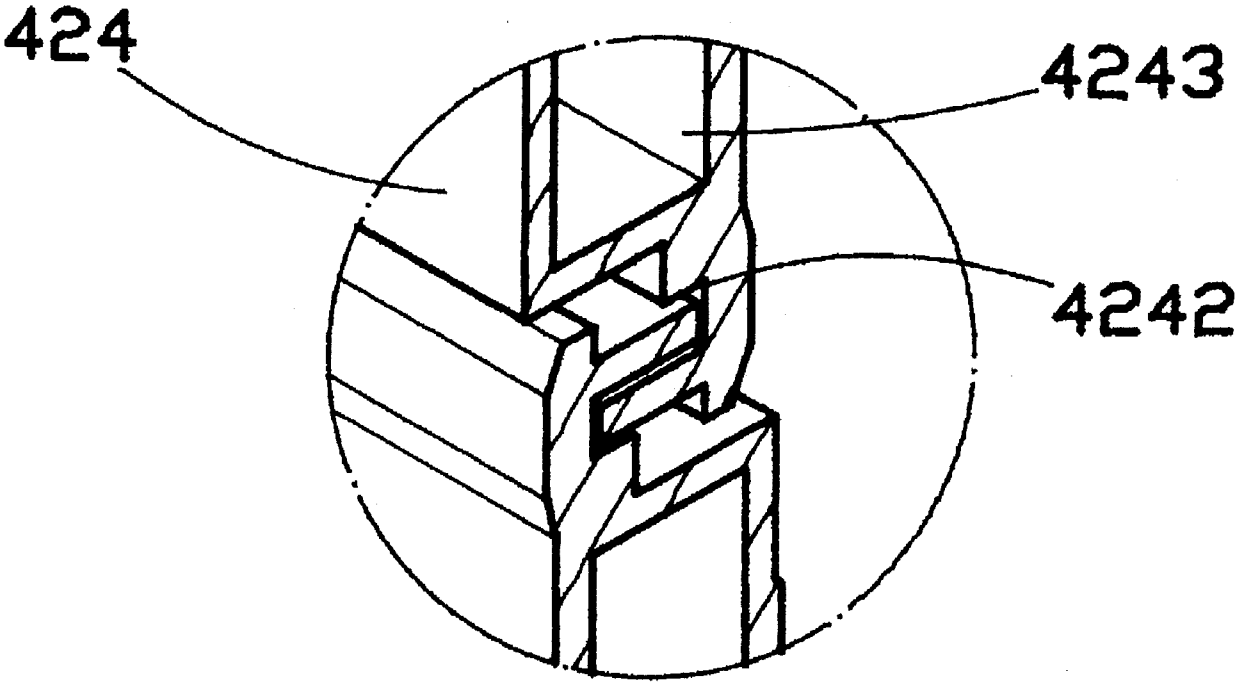

Referring to FIGS. 5 and 6, the shutter transmission mechanism is comprised of a motor drive 24 and a plurality of transmission devices 20. The transmission device 20 is comprised of a gear box 21, a spur gear 22, a spiral gear 23, and a transmission rod 25. The gear box 21 is comprised of a first shell 211 and a second shell 212. The first shell 211 comprises two parallel supports 211, which support the second shell 212, a chamber 2115 defined between the supports 211, a plurality of pins 2114 raised from one support 211, a round hole 2112 horizontally disposed in the middle of chamber 2115, two vertically aligned half-round holes 2113 near the supports 211, and a plurality of pins 2116 disposed in the chamber 215. The second shell 212 comprises a chamber 2123 matched with the chamber 2115 of the first shell, a plurality of pin holes 2124 inside the chamber 2123, which receive the pins 2116 respectively, a round hole 2121 aligned with the round hole 2112 to hold the spur gear 22, two vertically aligned half-round holes 2122 matched with the half-round holes 2113 to hold the spiral gear 23, a side block 2125 at one side by the chamber 2123, and a plurality of pin holes 21251 on the side block 2125, which receive the pins 2114 respectively. The spur gear 22 comprises a tooth face 221 meshed with the tooth face 231 of the spiral gear 23, two coupling portions 222 at two opposite ends respectively inserted into the round holes 2112 and 2122, and a longitudinal center through hole 223, which receives the transmission rod 25. The spiral gear 23 comprises a tooth face 231 meshed with the tooth face 221 of the spur gear 22, two coupling portions 232 at two opposite ends respectively inserted into the half-round holes 2113 and 2122, and a longitudinal center through hole 233. The motor drive 24 is coupled to a transmission gear 241 having an axle connector 242 and an output shaft 243 coupled to the axle connector 242. The output shaft 243 is inserted through the longitudinal center through hole 233 of the spiral gear 23 and turned to rotate the spiral gear 23. The transmission rod 25 has a rod section 251 at one end fitted into the longitudinal center through hole 223 of the spur gear 22, and connecting block 252 at an opposite end fastened to one louver 424 of the shutter 42.

Figure 7:
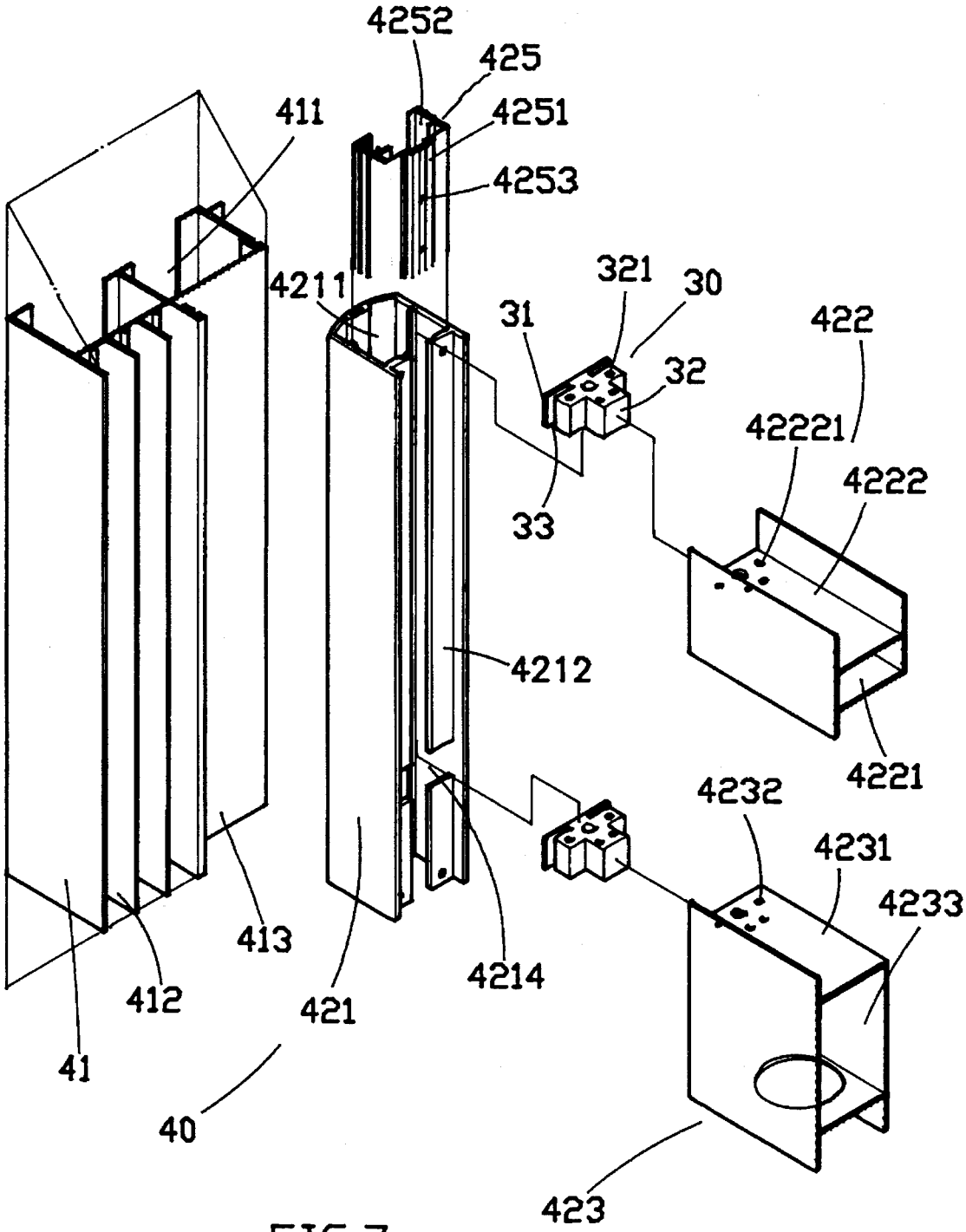
FIG. 7 shows the structure of positioning of coupling blocks between one stile and the top and bottom rail of the shutter according to the present invention.
Figure 8:
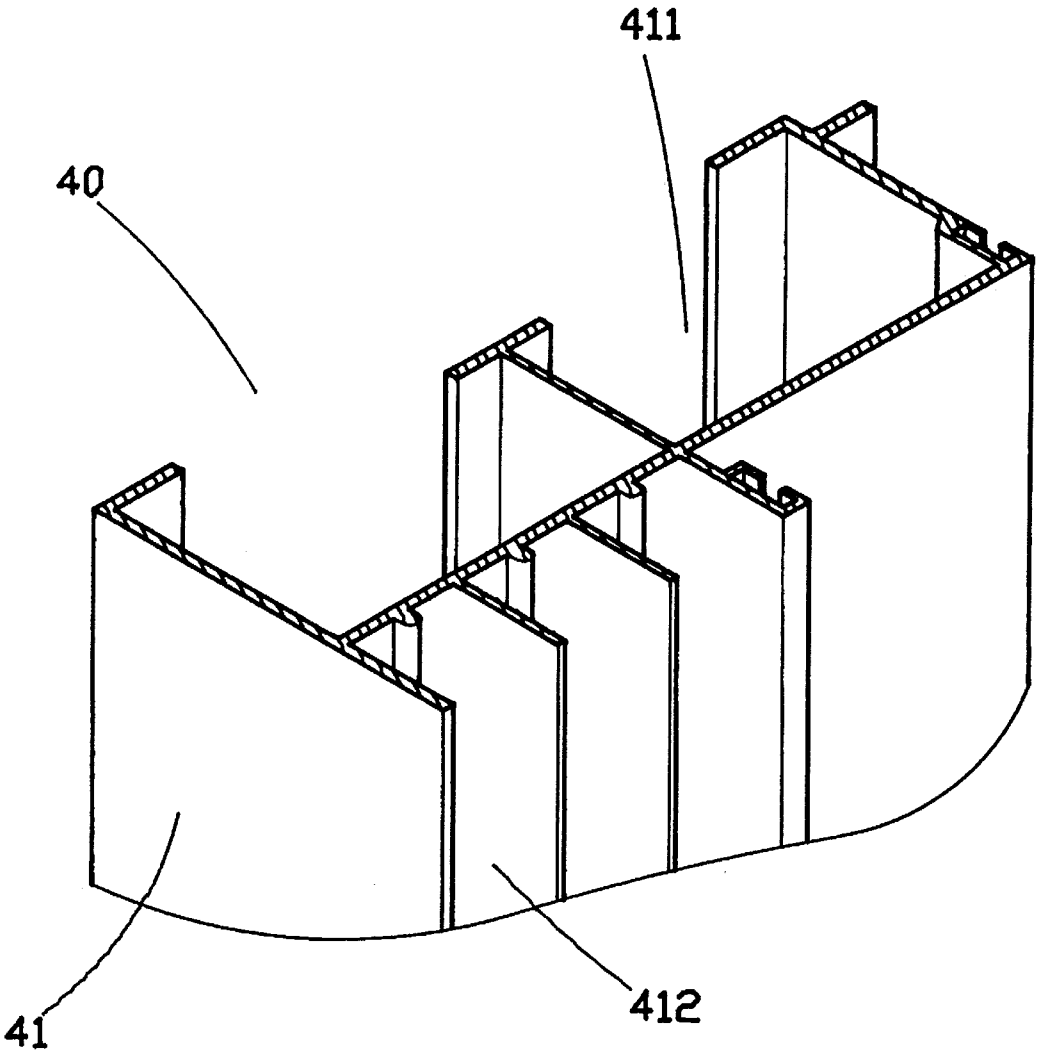
FIG. 8 is a partial view in an enlarged scale of the outer window frame of the aluminum window frame unit according to the present invention.
Figure 9:
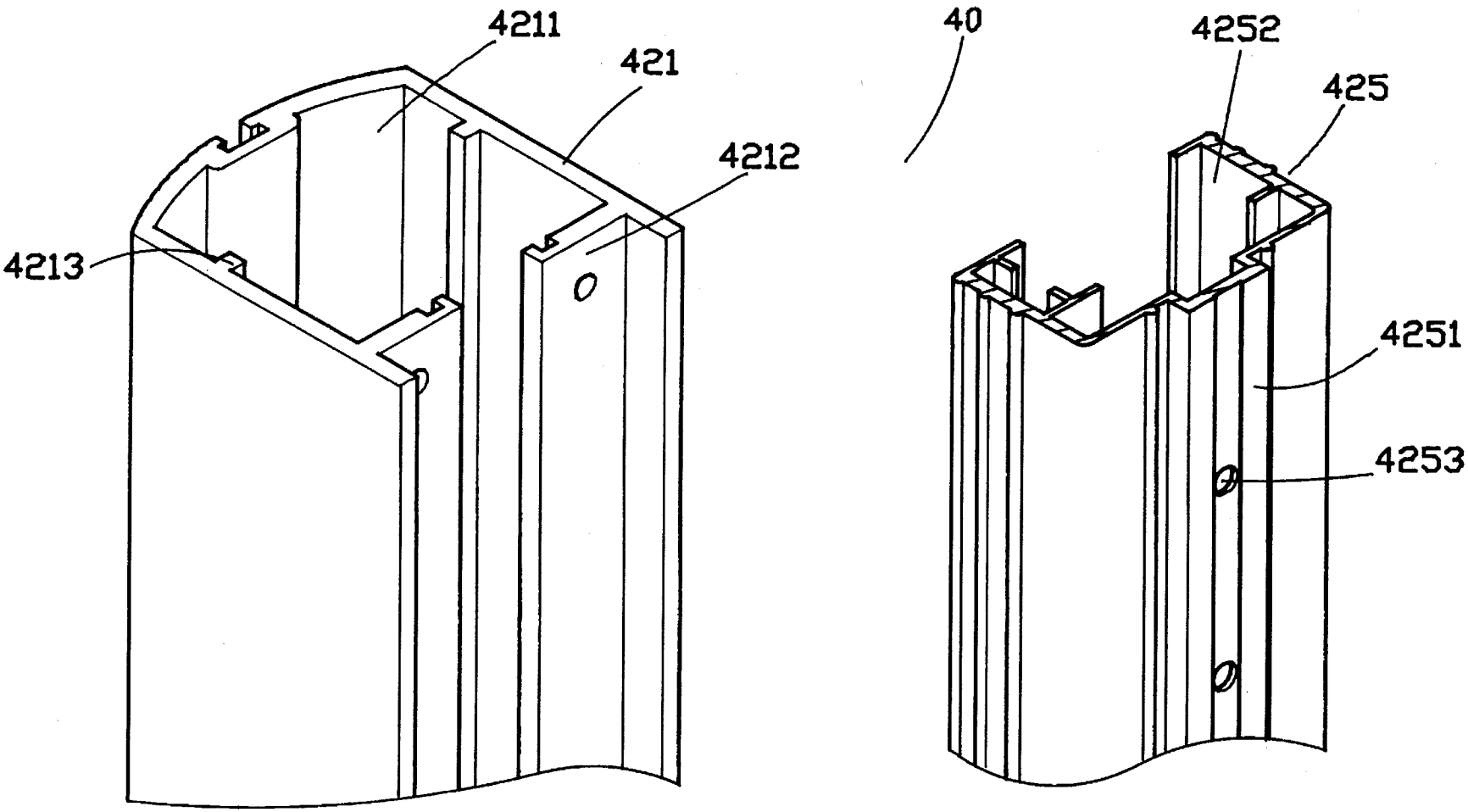
FIG. 9 is a partial view in an enlarged scale of one stile and one packing strip of the shutter according to the present invention.
Figure 10:
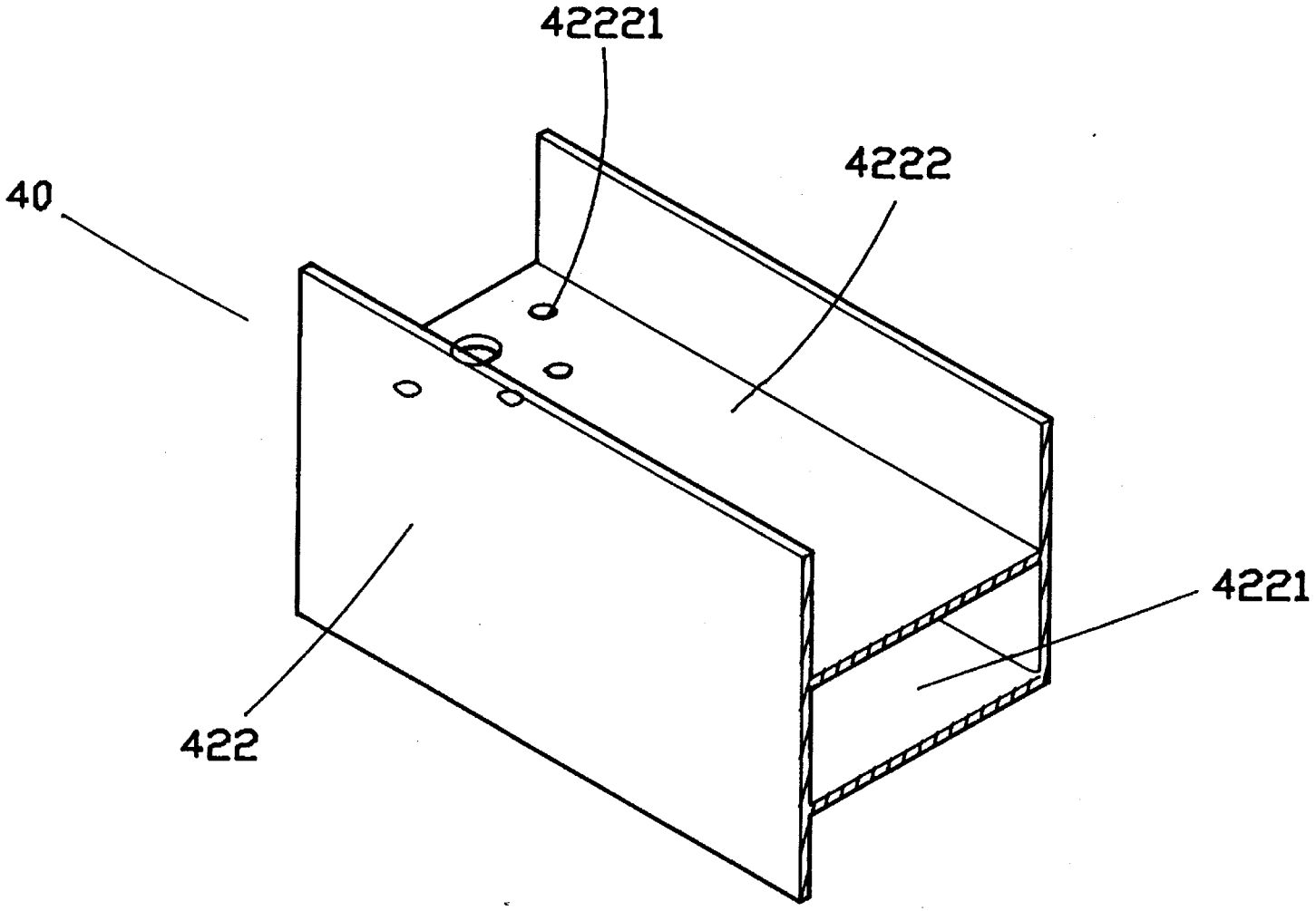
FIG. 10 is a partial view in an enlarged scale of the top rail of the shutter according to the present invention.
Figure 11:
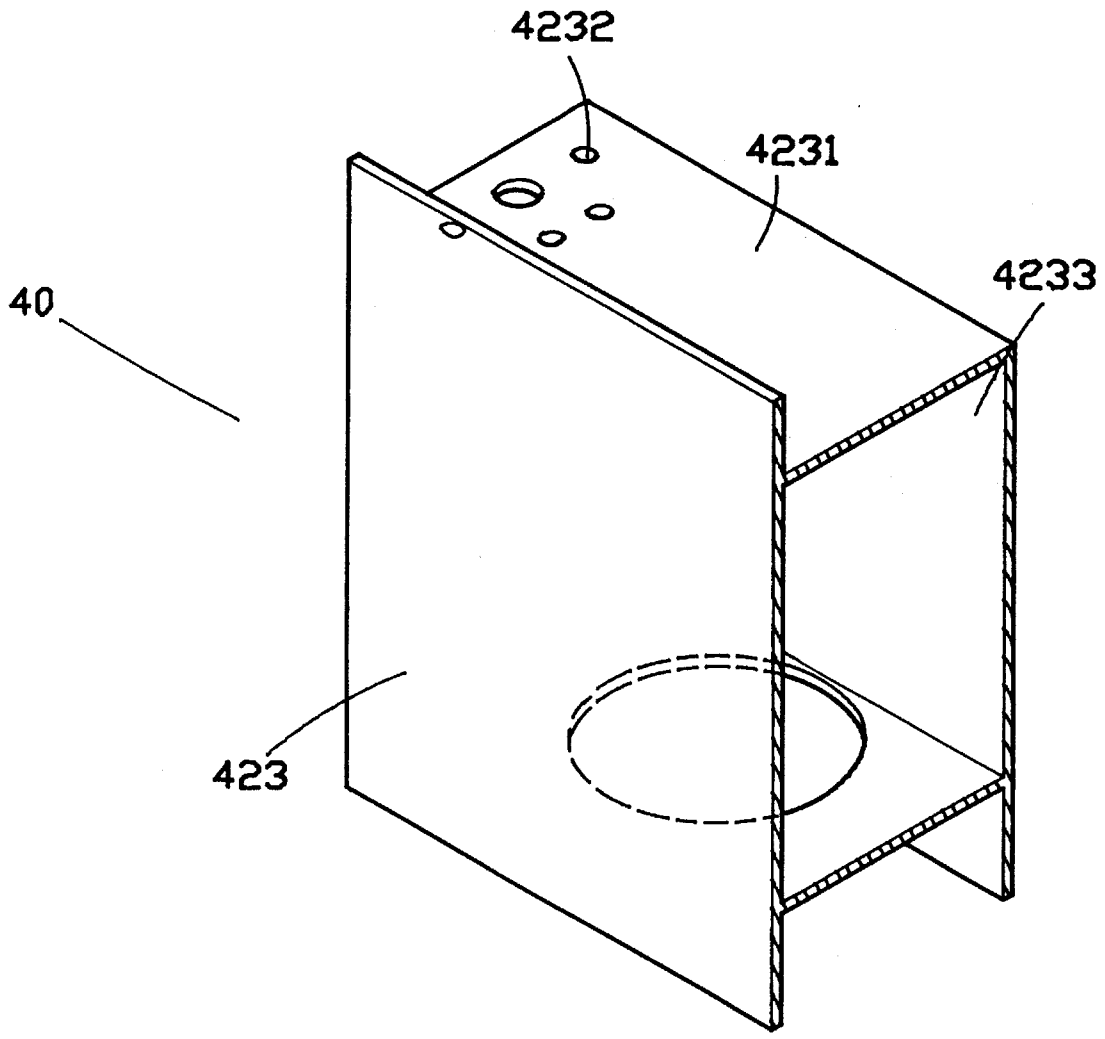
FIG. 11 is a partial view in an enlarged scale of the bottom rail of the shutter according to the present invention.
Figure 12:
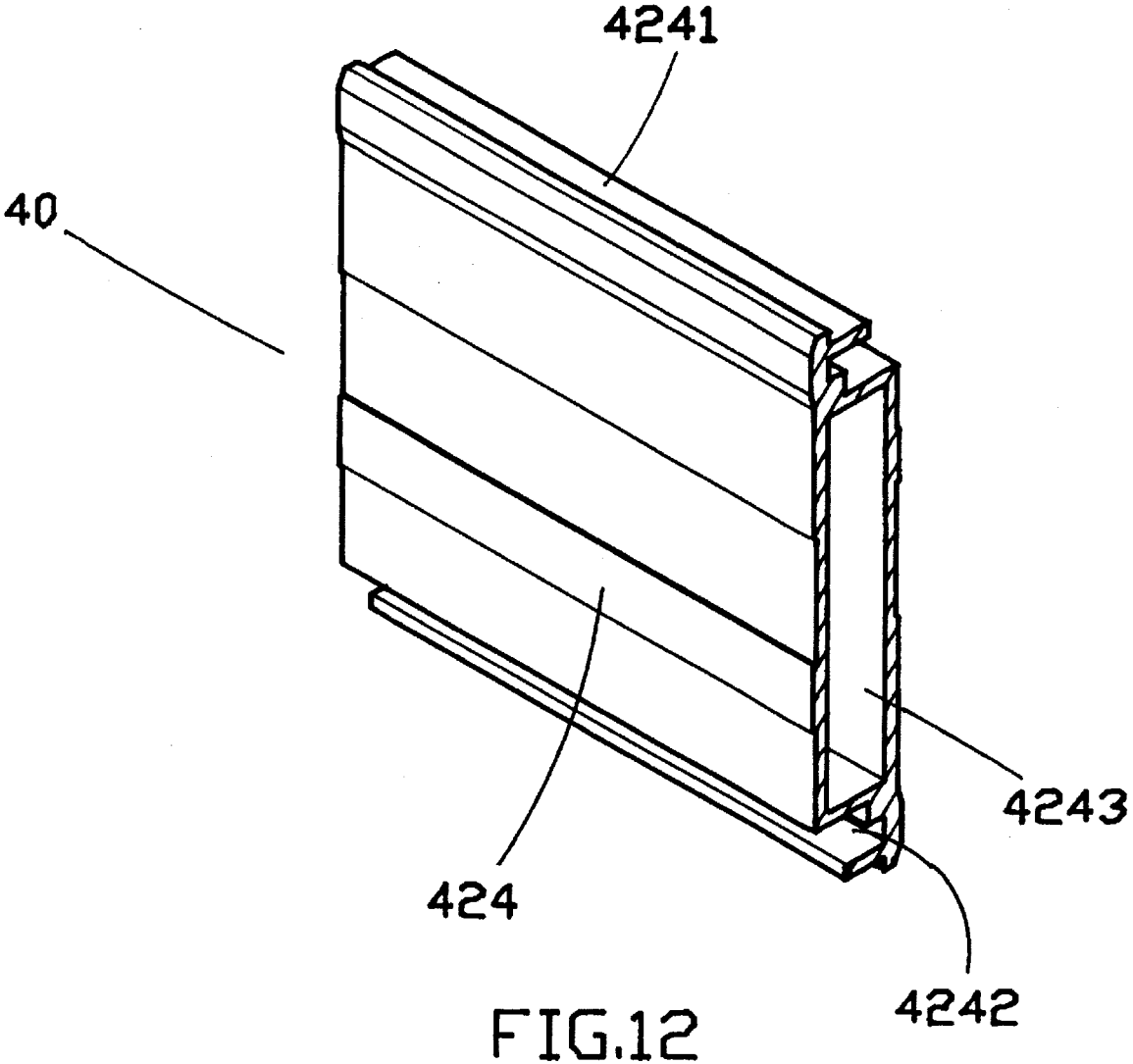
FIG. 12 is a partial view in an enlarged scale of a louver according to the present invention.

Referring to FIG. 7, the coupling block 30 comprises a first coupling portion 31 at one end, a second coupling portion 32 at an opposite end, two openings 33 bilaterally disposed between the first and second coupling portions 31 and 32, and a plurality of screw holes 321 through the second coupling portion 32. The first coupling portion 31 is fastened to the inside chamber 4211 of the stile 421 by engaging the inside flanges 4212 into the openings 33. The second coupling portion 32 is fastened to the top rail 422 or bottom rail 423.

Referring to FIGS. 7 through 12, the aluminum window frame unit 40 is comprised of an outer window frame 41, and a shutter 42. The outer window frame 41 is rectangular open frame comprising an inside chamber 411 to which the upper locating block 11 and the lower locating block 12 are fastened, and a plurality of longitudinal grooves 412 and 413, which hold a screen window (not shown), a glass window (not shown), and the shutter 42. The shutter 42 comprises two stiles 421, a top rail 422, a bottom rail 423, and a plurality of louvers 424, and two packing strips 425 respectively fitted into the stiles 421 to hold the shutter transmission mechanism. The stile 421 is comprises an inside chamber 4211 to which the pivot holders 12 and the coupling blocks 30 are fastened, two inside flanges 4212 longitudinally raised from the inside chamber 4211 at two opposite sides and respectively fitted into the openings 33 on the coupling blocks 30, two longitudinal ribs 4213 raised from the inside chamber 4211, and an opening 4214 on the inside flanges 4212 to which one coupling block 30 is fastened to hold the bottom rail 423. The packing strips 425 are respectively fastened to the inside chambers 4211 of the stiles 421 and retained between the longitudinal ribs 4213 and the inside flanges 4212 to hold the shutter transmission mechanism, each having a longitudinal rib 4251 retained between the inside flanges 4212, an inside chamber 4252, which receives the gear boxes 21 of the transmission devices 20, and a plurality of vertically spaced pin holes 4253, which receive the rod sections 251 of the transmission rods 25. The top rail 422 comprises a longitudinal chamber 4221, which receives the second coupling portions 32 of the respective coupling blocks 30, a longitudinal groove 4222 disposed above the longitudinal chamber 4221, and a plurality of screw holes 42221 on the longitudinal groove 4222 at two opposite ends and respectively connected between the screw holes 321 on the respective coupling blocks 30 and the screw holes 12351 of the angle frames 1235 of the respective pivot holders 123. The bottom rail 423 comprises a longitudinal chamber 4233, which receives the motor drive 24, a longitudinal groove 4231, and a plurality of screw holes 4232 on the longitudinal groove 4231 at two opposite ends respectively connected to the screw holes 321 on the respective coupling blocks 30. The louver 424 comprises two reversed hooks 4241 and 4241 at two opposite sides, and a longitudinal through hole 4243, which receives the connecting block 252 of the respective transmission rod 25. When the shutter 42 is closed, the reversed hooks 4241 and 4242 of the louvers 424 are hooked with one another, and therefore hammer and bar are effectively resisted.

Figure 13:
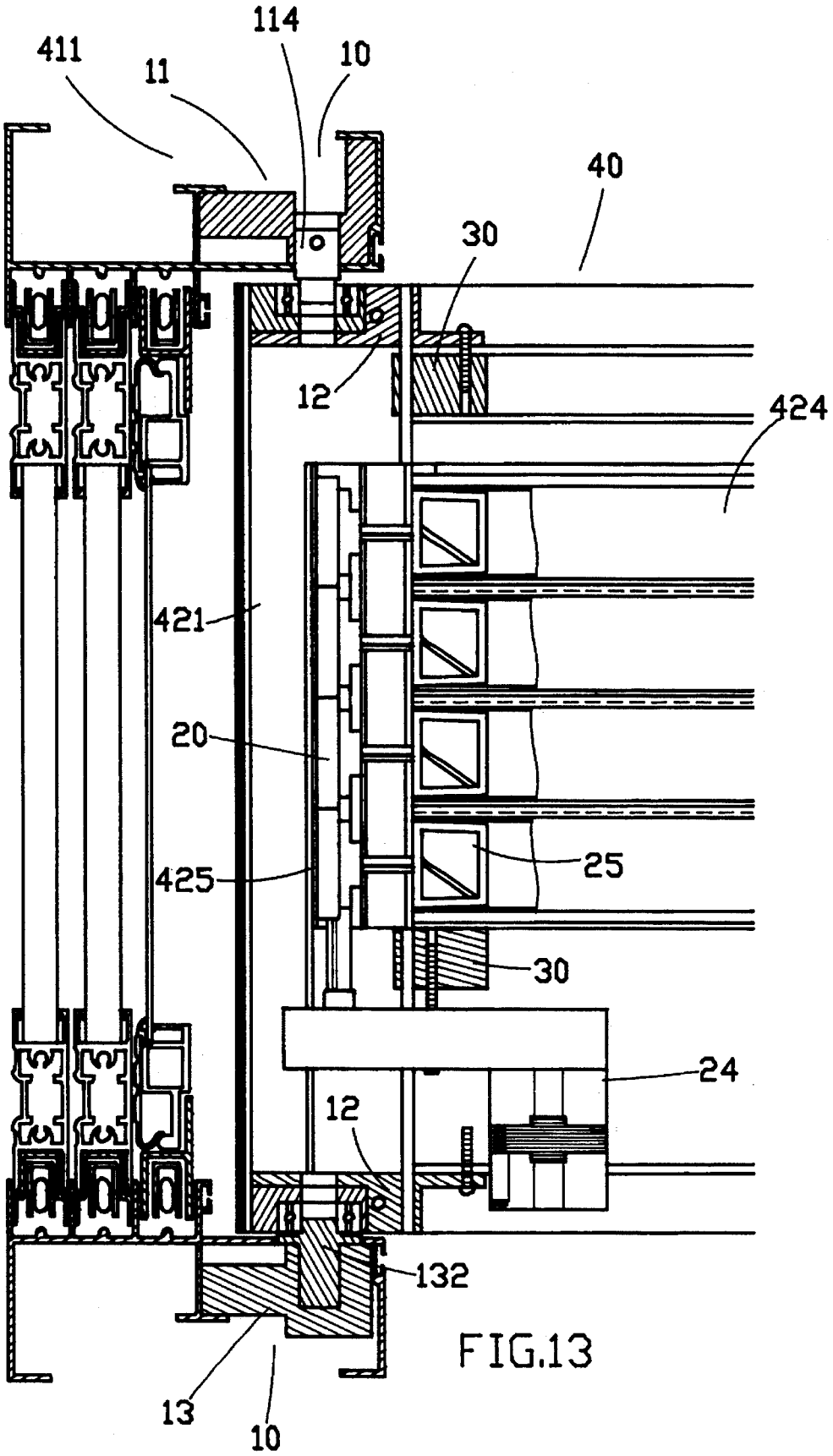
FIG. 13 is a partial view in section in an enlarged scale of the shutter window assembly of FIG. 1.

Referring to FIG. 13, the aluminum frames of the outer window frame 41 are connected into shape by connecting frames 414. When the outer window frame 41 is set up, the upper locating blocks 11 and the lower locating blocks 13 are respectively fastened to the inside chamber 411 of the outer window frame 41, then the coupling blocks 30 are respectively fastened to the inside chambers 4211 of the stiles 421 of the shutter 42, permitting the inside flanges 4212 to be respectively fitted into the openings 33, and then the top rail 422 and the bottom rail 423 are respectively connected to the stiles 421 and fixedly fastened to the coupling blocks 30, and then the pivot holders 12 are respectively connected between the inside chambers 4211 of the stiles 421 and the top and bottom rails 422 and 423, and then the gear boxes 21 of the transmission devices 20 are installed in the inside chambers 4252 of the packing strips 425, and then the packing strips 425 are respectively inserted into the stiles 421 of the shutter 42 and retained between the inside flanges 4212 and the longitudinal ribs 4213, and then the motor drive 24 is installed in the longitudinal chamber 4233 of the bottom rail 423, and then the connecting blocks 252 of the transmission rods 25 are respectively fitted into the longitudinal through holes 4243 of the louvers 424, and then the rod sections 251 of the transmission rods 25 are respectively inserted through the pin holes 4253 on one packing strip 425 into the longitudinal center through holes 223 of the spur gears 22 of the transmission devices 20, and then the axle bearings 121 are mounted around the bolt 114 and the bolt 132.

Figure 14:
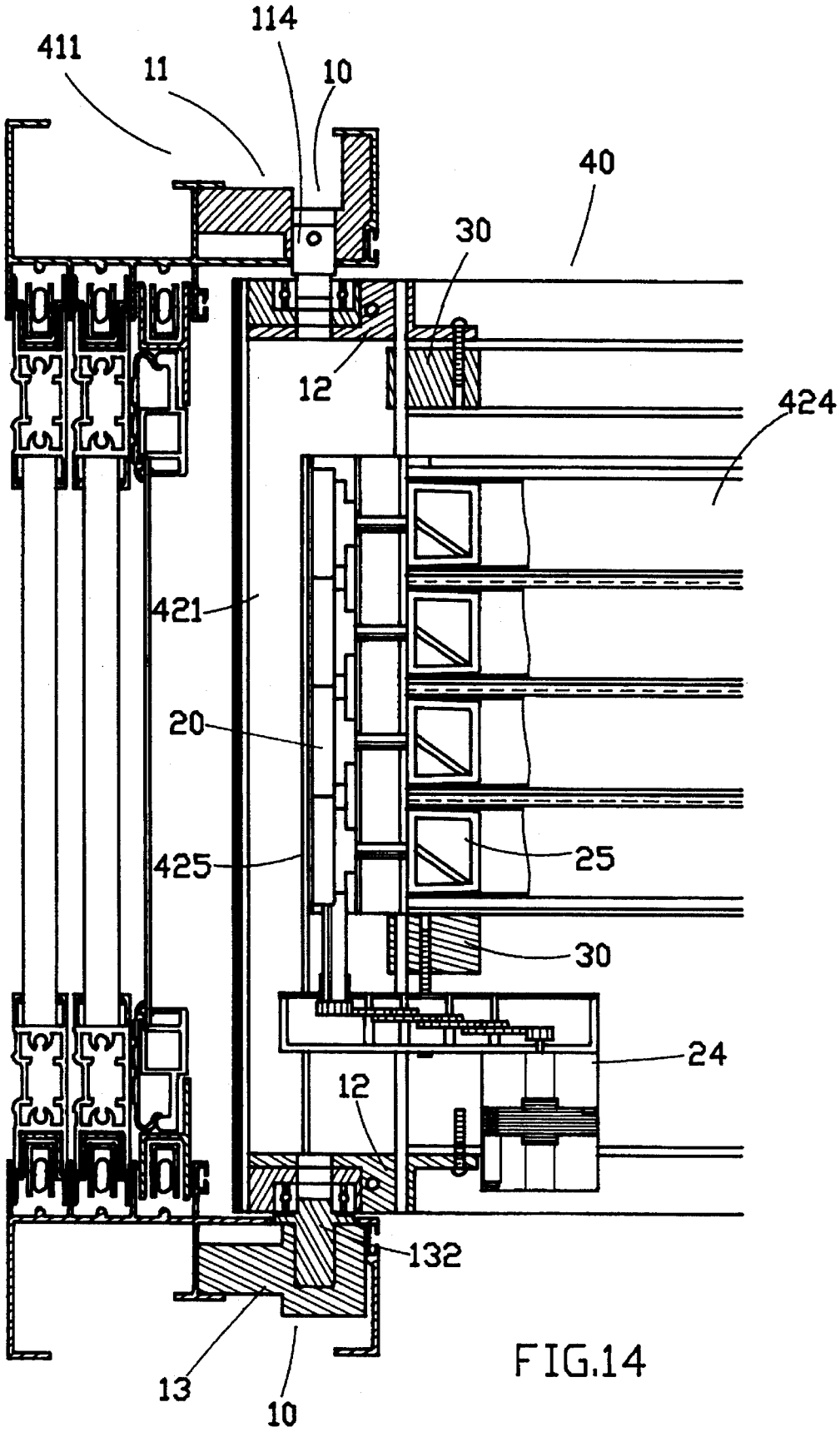
FIG. 14 is similar to FIG. 13 but showing the motor drive operated.

Referring to FIG. 14, when the motor drive 24 is started to turn the output shaft 243, the spiral gears 23 are turned to rotate the spur gears 22, causing the louvers 442 of the shutter 42 closed or opened.

While only one embodiment of the present invention has been shown and described, it will be understood that various modifications and changes could be made without departing from the spirit and scope of the invention.

What is claimed is:

1. A shutter window assembly comprising:

an aluminum window frame unit including an outer window frame and a shutter, said outer window frame being a rectangular open frame comprising an inside chamber and a plurality of longitudinal grooves vertically disposed at two opposite sides, said shutter being fastened to said longitudinal grooves of said outer window frame, comprising two stiles, a top rail, a bottom rail, a plurality of louvers, and two packing strips respectively fastened to said stiles on the inside, each stile comprising an inside chamber, two inside flanges longitudinally raised from the inside chamber at two opposite sides, and two longitudinal ribs raised from the inside chamber, said packing strips being respectively fastened to the inside chambers of said stiles and retained between the longitudinal ribs and inside flanges of said stiles, each packing strip having a longitudinal rib retained between the inside flanges of the respective stile, and inside chamber, and a plurality of vertically spaced pin holes, said top rail comprising a longitudinal chamber, a longitudinal groove, and a plurality of screw holes on the longitudinal groove of said top rail at two opposite ends, said bottom rail comprising a longitudinal chamber, a longitudinal groove, and a plurality of screw holes on the longitudinal groove of said bottom rail at two opposite ends, said louvers each comprising a longitudinal through hole, and two reversed hooks disposed at two opposite sides at different elevations;

two pairs of coupling blocks to connect said top and bottom rails to said stiles, each coupling block comprising a first coupling portion at one end fastened to the inside chamber of one stile, a second coupling portion at an opposite end fastened to the longitudinal chamber of said top or bottom rail, two openings bilaterally disposed between said first and second coupling portions, which receive the inside flanges of one stile, and a plurality of screw holes through said second coupling portion respectively connected to the screw holes at one end of said top or bottom rail;

two hinge devices connected between said shutter and said outer window frame permitting said shutter to be retained within said outer window frame, each hinge device comprised of an upper locating block, two pivot holders, and a lower locating block, said upper locating block comprising a flat base, an upright connecting block raised from said flat base at one side and having a pair of mounting holes fastened to said outer window frame, an elongated chamber disposed on said flat base along said upright connecting block, a vertical center through hole through the center of said elongated chamber, a bolt inserted into said vertical center through hole and having a side hole, a rod having one end fitted into the side hole on the bolt of said upper locating block and an opposite end made with a screw hole, an adjusting screw threaded into the screw hole on the rod of said upper locating block and turned to adjust the elevation of the bolt of said upper locating block, a horizontal T-block horizontally extended from said flat base opposite to said upright connecting block and having a center screw hole and two mounting holes, the mounting holes of said horizontal T-block being fastened to said outer window frame, and a balance adjustment screw threaded into the center screw hole on said horizontal T-block, said balance adjustment screw of said upper locating block being turned to adjust the horizontal balance of said aluminum window frame unit when said aluminum window frame unit is mounted within a hole on a wall, said lower locating block comprising a vertical locating hole, a bolt inserted into said vertical locating hole and having an outward horizontal flange stopped above said vertical locating hole, a vertical screw hole disposed in parallel with said vertical locating hole, a balance adjustment screw threaded into said vertical screw hole and adjusted to regulate the balance of said outer window frame of said aluminum window frame unit when said outer window frame is installed, and a plurality of mounting holes spaced along two opposite sides respectively fastened to the inside chamber of said window frame of said aluminum window frame unit, each pivot holder comprising a bearing block having a bearing hole and a projecting block, said projecting block having a screw hole, an axle bearing received in the bearing hole to hold the bolt of said upper or lower locating block, and a locating block connected between said bearing block and said shutter, said locating block comprising an U-channel, a stop block in said U-channel, a screw hole on said stop block connected to the screw hole on said projecting block of said bearing block by a screw, an angle frame connected to the inside flanges of the inside chamber of one stile of said shutter; and a shutter transmission mechanism comprised of a motor drive installed in the longitudinal chamber of said bottom rail and having an output shaft, and a plurality of transmission devices disposed inside one stile and connected between said output shaft and said louvers, each transmission device comprising a gear box mounted around said output shaft, a spiral gear mounted inside said gear box and turned by said output shaft, a spur gear mounted inside said gear box and turned by said spiral gear, and a transmission rod coupled between said spur gear and one louver, said gear box comprising a first shell and a second shell, said first shell comprising two parallel supports, which support said second shell, a chamber defined between said supports, a plurality of pins, a round hole, two vertically aligned half-round holes, and a plurality of pins, said second shell comprising a chamber matched with the chamber of said first shell, a plurality of pin holes, which receive the pins of said first shell, a round hole aligned with the round hole on said first shell to hold said spur gear, and two vertically aligned half-round holes matched with the half-round holes of said first shell to hold said spiral gear, said spur gear having two coupling portions at two opposite ends respectively inserted into the round holes on said first and second shells, and a longitudinal center through hole, which receives said transmission rod, said spiral gear being fixedly mounted around said output shaft and meshed with said spur gear and having two coupling portions at two opposite ends respectively inserted into the half-round holes on said first and second shells, said transmission rod having a rod section at one end fitted into the longitudinal center through hole on said spur gear, and connecting block at an opposite end fastened to one louver.

* * * * *